US006241272B1

(12) United States Patent
Hämmerle

(10) Patent No.: US 6,241,272 B1
(45) Date of Patent: Jun. 5, 2001

(54) PAIR OF SKIS FOR ALPINE SKIING

(75) Inventor: Gerhard Hämmerle, Radstadt (AT)

(73) Assignee: Atomic Austria GmbH, Altenmarket (AT)

( * ) Notice: Subject to any disclaimer, the term of this patent is extended or adjusted under 35 U.S.C. 154(b) by 0 days.

(21) Appl. No.: 09/051,829

(22) PCT Filed: Jun. 23, 1997

(86) PCT No.: PCT/AT97/00139

§ 371 Date: Apr. 28, 1998

§ 102(e) Date: Apr. 28, 1998

(87) PCT Pub. No.: WO98/00205

PCT Pub. Date: Jan. 8, 1998

(30) Foreign Application Priority Data

Jun. 27, 1996 (AT) ..... 1141/96

(51) Int. Cl.[7] ..... A63C 5/048

(52) U.S. Cl. ..... 280/609; 280/601; 280/602; 280/608

(58) Field of Search ..... 280/609, 608, 280/601, 602, 610

(56) References Cited

U.S. PATENT DOCUMENTS

| | | | | |
|---|---|---|---|---|
| 2,510,794 | | 6/1950 | Beerli | 280/11.13 |
| 4,700,967 | * | 10/1987 | Meatto et al. | 280/609 |
| 4,895,388 | * | 1/1990 | Richmond | 280/609 |
| 4,971,350 | * | 11/1990 | Fagot | 280/609 |
| 5,096,217 | * | 3/1992 | Hunter | 280/607 |
| 5,242,187 | * | 9/1993 | Diard et al. | 280/609 |
| 5,405,161 | * | 4/1995 | Petkov | 280/609 |
| 5,649,722 | * | 7/1997 | Champlin | 280/818 |

FOREIGN PATENT DOCUMENTS

| | | |
|---|---|---|
| 2517548A | 6/1983 | (FR) . |
| 2559673A | 8/1985 | (FR) . |
| WO 96/22135A | 7/1996 | (WO) . |

* cited by examiner

*Primary Examiner*—Brian L. Johnson
*Assistant Examiner*—Dianne Draper

(57) ABSTRACT

A pair of skis for alpine skiing, with asymmetrically waisted skis (1, 2), each ski (1, 2) at its outside comprising a sidecut (24) of heavier curvature than at its inside; to facilitate parallel guiding of the skis when going through curves, with equally loaded skis (1, 2), the waisting at the outside of each ski (1, 2) is rearwardly offset relative to that at the inside by a distance (X) in the range of centimeters, and the beginning of the waisting (24) at the outside of each ski (1, 2), following upon the shovel region, is outwardly offset as compared to the waisting (25) at the inside, by a distance (Y) in the range of millimeters; in this manner, when going in curves, when the two skis (1, 2) are guided at a distance (D) in the range of decimeters from each other, with the outer ski (1) rearwardly offset in travel direction relative to the inner ski (2), the waistings (24; 15) of the outside of the inner ski (2) and of the inside of the outer ski (1) describe at least approximately concentric arcs (16, 26).

13 Claims, 3 Drawing Sheets

PAIR OF SKIS FOR ALPINE SKIING

The invention relates to a pair of skis for alpine skiing with asymmetrically waisted skis, each ski at its outside having a sidecut of heavier curvature than on its inside.

BACKGROUND OF THE INVENTION

In common skiing techniques, when going through curves, the outer ski (i.e. that ski which is outwardly arranged in the curve) of a pair of skis is loaded, whereas the inner ski remains more or less unloaded. For going in curves, thus, in this type of skiing technique primarily the shape of the inside of the respective outer ski is of importance. To facilitate the triggering of a swing, the most varying ski geometries have already been suggested in this connection, cf., e.g., AT 387,147 B or the corresponding FR 2,559,673 A, wherein, for going in curves more easily, particularly in fresh snow, a specific, heavy waisting has been suggested, which, moreover, in the front and rear parts is to merge into straight sections via kinks. A comparable ski comprising straight sections in the shovel region and in the end region and having a heavy waisting is furthermore described in DE 4,112,950 A1. Therein, also different curvatures of the sidecuts at the inside and outside, respectively, of the ski for adapting the traveling behavior to the desired conditions of use has been disclosed. In detail, according to DE 4,112,950 A1 the curvature at the inside of the ski is to be more pronounced than that on the outside of the ski. On the other hand, from the afore-mentioned FR 2,559,673 A as well as from AT 316,376 B, there result ski geometries in which the outsides of the skis have more heavily curved sidecuts than the insides. According to AT 316,376 B this situation is given if the skis of a pair of skis, in which preferably the inside curvature of the skis is more heavy than the outside one, are interchanged, to make them particularly suitable for long-drawn giant slalom turns instead of short turns.

The known ski designs have in common that they are designed for a conventional skiing technique, in which particularly "the inner edge" of the outer ski (or bottom ski) is traveled on, where, due to the respective shape or geometry of the sidecut at this inside, the suitability for shorter or longer turns is maintained for an easier triggering of the turn etc.

A new skiing technique is the socalled "carving" technique, in which the skier tries to load both skis as uniformly as possible also when going in curves; this new technique has originated from snowboarding, and, similar to snowboarding, when skiing according to the carving technique, a turn, i.e. traveling in curves, is simply introduced in that the legs in the region of the knee joints are "switched over", with equal load on both skis, in which case the curve is to be traveled both on the inner edge of the outer ski and on the outer edge of the inner ski. In this instance, the known skis all give rise to problems, since the turns given by the waistings of the inner edge of the outer ski and of the outer edge of the inner ski, respectively, are not "parallel" to each other, but intersect one another. When going in curves according to the carving technique, consequently the inner ski cannot or can only with difficulty be guided in parallel to the outer ski; the skis will cross each other, or the inner ski will be drawn away from the outer ski, causing falls.

SUMMARY OF THE INVENTION

The invention has as its object to provide a pair of skis of the initially defined type which solves these problems and, on account of its design, is particularly suited for the carving skiing technique.

The pair of skis according to the invention, of the initally defined type, is characterized in that the waisting at the outside of each ski is rearwardly offset relative to that at the inside by a distance in the range of centimeters, wherein, when going through curves, when the two skis are guided at a distance in the range of decimeters from each other, with the outer ski rearwardly offset in travel direction relative to the inner ski, the waistings of the outside of the inner ski and of the inside of the outer ski describe at least approximately concentric curves.

In the pair of skis according to the invention, by the fact that the respective skis do not only have a heavier curvature of the waisting at the outside as compared to the inside, but also the waisting at the outside of each ski is rearwardly offset relative to that at the inside (by which tribute is paid to the fact that the innser ski will be led forwardly of the outer ski when going in curves), an at least approximately concentric course of the curves defined by the waistings at the outside of the inner ski and on the inside of the outer ski, respectively, is obtained. On account of the thus approximately "parallel" curves followed by the inner edge of the outer ski as well as by the outer edge of the inner ski, despite loading also the inner ski when skiing according to the carving technique, it becomes possible to maintain the two skis generally parallel to each other when going through curves with the skis guided relatively wide apart, thus avoiding crossing or the like.

To attain as good a parallel ski guidance as possible when going in curves, by rearwardly offsetting the outside waisting in combination with the heavier curvature of the outside waisting, it is particularly advantageous if the centers of curvature of the waistings at the inside of the outer ski and of the outside of the inner ski substantially coincide, at a center-to-center ski distance of approximately 30 cm to 50 cm, in particular approximately 40 cm to 45 cm, and at a rearward offset of the outer ski relative to the inner ski of approximately 10 cm to 25 cm, in particular approximately 15 cm to 20 cm.

To facilitate travelling according to the concentric curves defined by the inner edge of the outer ski as well as by the outer edge of the inner ski, with comparatively generally useful radii of curvature, i.e. useful for any type of curve (narrow or long-drawn), it has also proven advantageous if the beginning of the waisting at the outside of each ski, following upon the shovel region, is outwardly offset as compared to the waisting at the inside, by a distance in the range of millimeters, the offset of the waisting at the ski outside disappearing rearwardly. In this manner it becomes possible to let the radii of curvature of the outside and inside waistings, respectively, not differ too much from each other, and to keep small the amount of the rearward offset of the waisting at the outside of the respective ski relative to that at the inside thereof; the difference between the radii of curvature may, e.g., be merely 2 m, or less than 10%, respectiely. Thus, in a pair of skis having a ski length of approximately 200 cm, the radii of curvature at the inside of the skis may be defined at approximately 28 m each and at the outside by approximately 26 m each; for shorter skis, having e.g. a length of 170 cm, the corresponding radii of curvature may be 26 m and 24 m, respectively. The preferably provided outward offset of the waisting at the outside of each ski as compared to the waisting at the inside (or as compared to a symmetrical design of the ski, respectively) is, e.g., in the range of approximately 1 mm up to (preferably) 1.5 mm for shorter ski lengths (approximately 170 cm) and at approximately 2 mm to 4 mm, preferably 2.5 mm, for greater ski lengths (approximately 200 cm)

On the other hand, in tests for the concentricity of curves sought, it has proven both possible and advantageous if—more or less irrespective of the ski length—the distance of the rearward offset of the beginning of the outside waisting of each ski in the region adjacent the ski shovel amounts to approximately 4 cm. Such a slight distance of a rearward offset is easily possible if, as has been mentioned, the beginning of the waisting at the ski outer side is outwardly offset.

For the desired parallel guiding of the skis when going through curves one embodiment of the ski geometry has proven suitable, according to which the waisting at the outside of each ski, in the region of the ski end, ends further rearwardly than the waisting at the ski inner side. With this embodiment, thus, despite its heavier curvature, the outside waisting of each ski ends behind the waisting at the inside of the ski, viewed in the direction of travel. For traveling according to "parallel" curves, it is furthermore suitable if the distance by which the waisting at the outside ends further rearwardly as compared to that at the inside is shorter than the distance of the rearward offset of the beginning of the waisting in the region adjacent the ski shovel. In particular, it can be provided that—again surprisingly substantially equally for all the common ski lengths—the distance of the rearward offset of the outside waisting in the region of the ski end is approximately 3 cm.

To avoid obtaining a ski design which widens plow-like contrary to the travel direction, because of the rearward offset of the beginning of the outside waisting of each ski between this beginning of the waisting and the site of contact located forwardly of the same, where the contact of the running surface of the ski with the substrate starts and from where the upwardly curved ski shovel extends forwardly, which plow-type design could have a braking effect, it is finally also advantageous if the outside of each ski, forwardly of the beginning of the waisting towards the shovel section, is designed to extend straight as well as diverging or preferably in parallel to the longitudinal axis of the ski. At the inner side, the waisting may merge continuously from the concave curvature into the convex curvature of the shovel region, in a per se conventional manner. This transition as well as the transition into the straight part of the ski outer side and from there into the convex shovel part at the outside of each ski may be attained by curve portions, so-called splines, to be smoothly assembled one after the other.

BRIEF DESCRIPTION OF THE DRAWINGS

In the following, the invention will be further illustrated in the drawings by way of a particularly preferred exemplary embodiment, to which, however, it shall not be restricted. In detail, the drawings show in FIG. 1 a schematic top view on a pair of skis, not true to scale, but with the shape of the outside waisting of the inner ski quite exaggerated so as to better illustrate the effect to be attained according to the invention, FIG. 2 a schematic top view, on a larger scale, of a comparable pair of skis, illustrated approximately true to scale.

DETAILED DESCRIPTION

Figure 1:
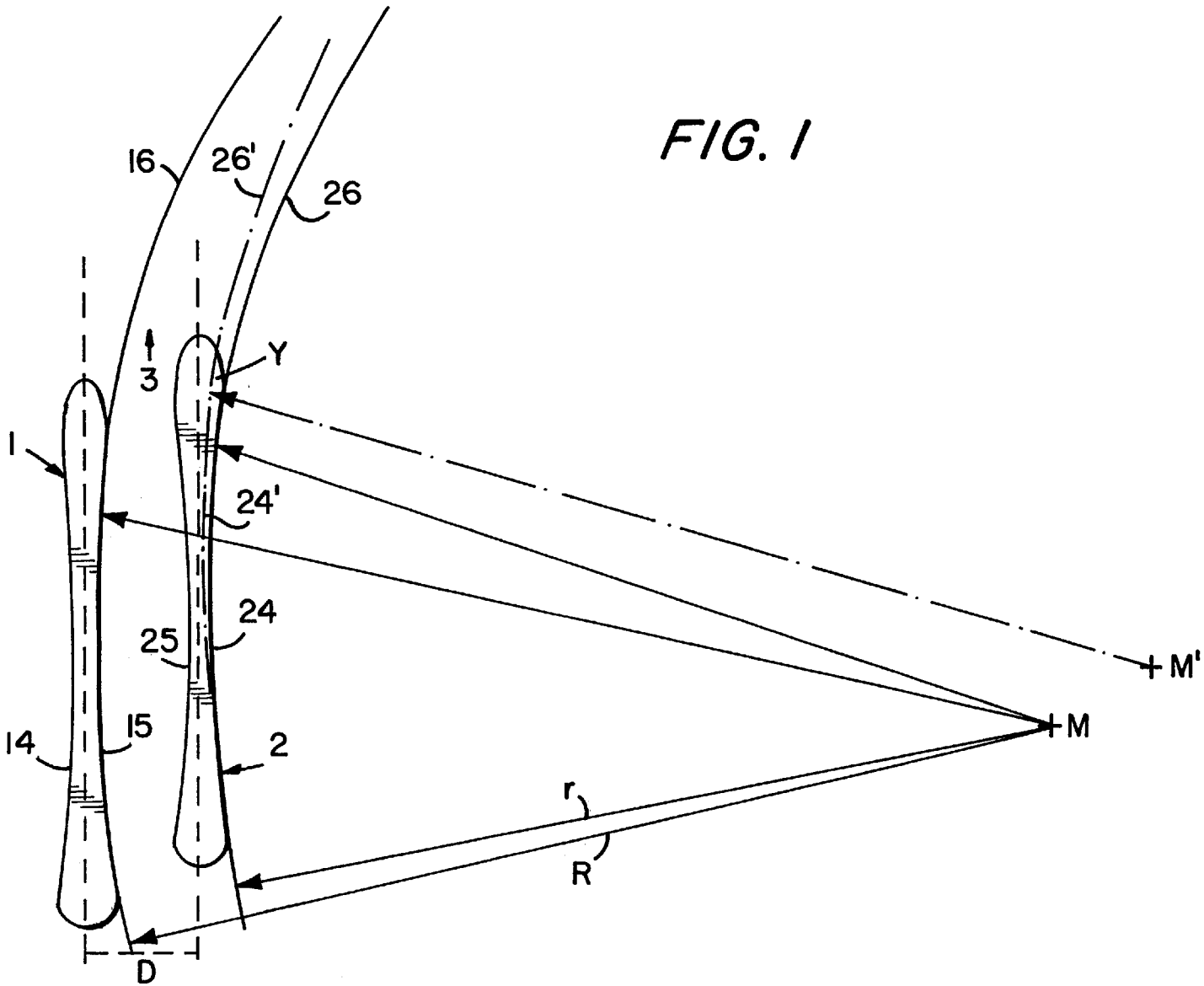

In FIG. 1, a pair of skis is schematically shown in top view when going through a curve, wherein the curve-wise outside ski, the outer ski 1, is rearwardly offset in the direction 3 of travel relative to the curve-wise inside ski, the inner ski 2. The two skis 1, 2 are waisted, a conventional, symmetric waisting being shown at the left-hand ski in FIG. 1, the outer ski 1, i.e. the sidecut 14 at the outer side (i.e. on the side facing away from the other ski 2) and the sidecut 15 at the inner side of the ski 1 have the same curvature. For the inner ski 2, an outside sidecut 24' having the same curvature as the sidecut 25 at the inner side is illustrated in dot-and-dash line. By this, when going in curves, e.g. according to FIG. 1 when making a right bend, curves 16 or 26', respectively, are defined by the inside waisting of the outer ski 1 or by the outside waisting of the inner ski 2, respectively, which are not concentric, cf. also the centers of curvature, M and M', respectively, but intersect at a distance in front of the skis 1, 2. As a consequence, the two skis 1, 2 cannot be guided easily in parallel while making curves by using the carving technique, but the inner ski 2 escapes laterally relative to the outer ski 1, or crosses the outer ski 1. What is decisive for this is, i.a., particularly the fact that usually, when going in curves, the inner ski 2, viewed in the direction of travel, is led forward of the outer ski 1, as is illustrated in FIG. 1. Moreover, also the center-to-center distance D of the two skis 1, 2 must be taken into consideration, which is relatively large, particularly in the new carving skiing technique, and will be in a range of from 30 cm to 50 cm, approximately 40 cm to 45 cm. Although this distance D between the skis could be balanced out by a sidecut 14 or 24', respectively, of heavier curvature at the respective ski outer side, as compared to the inside sidecut 15 or 25, respectively, i.e. by correspondingly large radii of curvature R for the curvature of the inside sidecuts 15 or 25, respectively, as compared to smaller radii of curvature r for the curvature of the outside sidecuts 14 or 24', respectively, the centers of curvature (cf. M and M', respectively, in FIG. 1) will still lie apart on account of the longitudinal offset of the skis 1, 2; thus, intersecting arcs 16 and 26', respectively, will still be obtained, which will be traveled with the inside of the outer ski 1 and with the outside of the inner ski 2.

Figure 3:
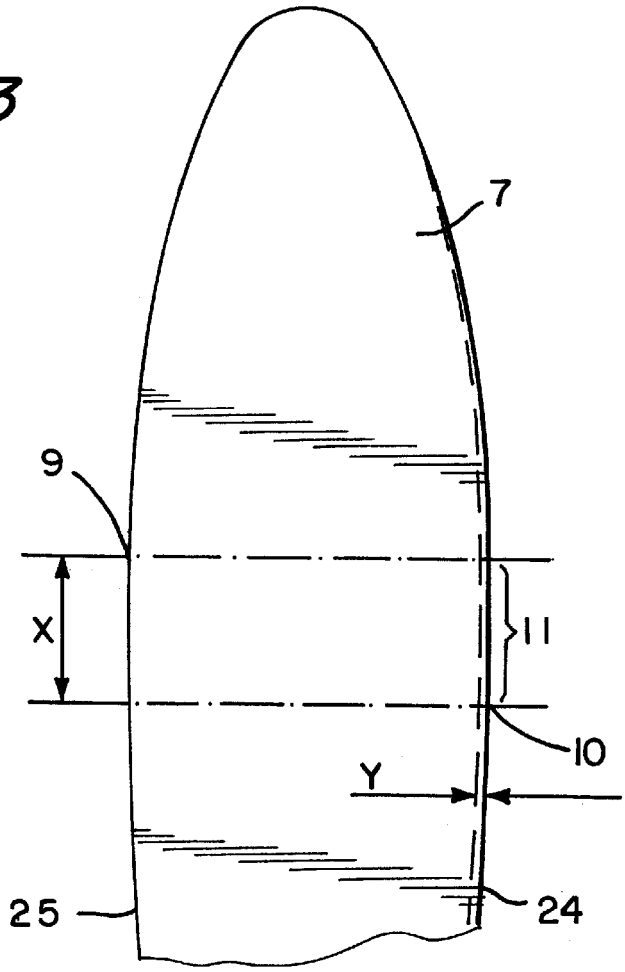
FIG. 3, in portions, a top view, on an elarged scale as compared to FIG. 2, of details regarding the offsets of the outside waisting of each ski in comparison with the inside waisting.
Figure 3:
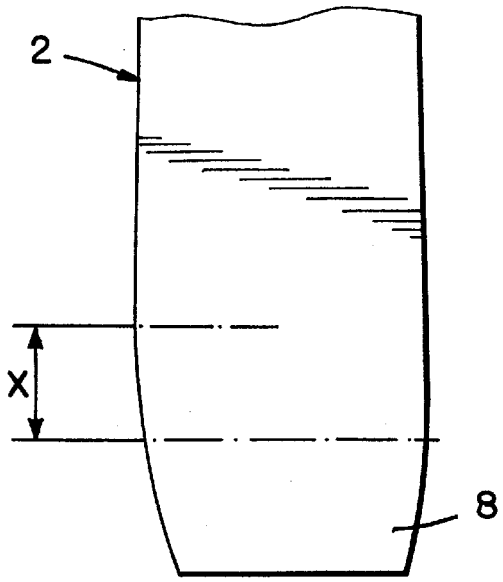

However, to attain as equal a load on outer ski 1 and inner ski 2, as possible, which is typical of the carving skiing technique, without the risk of the skis 1, 2, crossing one another, it would be necessary to travel along "parallel" arcs 16, 26, i.e. concentric arcs 16, 26 having one and the same center M, with the "inside edge" of the outer ski 1 and with the "outside edge" of the inner ski 2, respectively. With the present pair of skis, this will be achieved by a particular ski geometry which subsequently will be explained in more detail by way of FIG. 3. Above all, it is provided for the waisting, i.e. the concavely curve d sidecut 24 at the outside of each ski 1, 2 to be rearwardly offset relative to the waisting, i.e. the concavely curved sidecut 15 or 25, respectively, at the inside of the respective ski 1, 2, and this, in combination with a smaller radius of curvature r for the outside waisting, will allow for attaining concentrically extending arcs 16, 26, at least approximately. Since to this end, the longitudinal offset of the waistings would still have to be relatively large, which could be disadvantageous i.a. with a view to a stable straight travel with such skis, it is furthermore preferred to outwardly offset the waisting at the ski outer side, this outward-offset being the most pronounced at the beginning of the waisting, adjacent the ski shovel, and this outward-offset decreasing to zero towards the rear end of the ski. This is very exaggerated shown in FIG. 1 for the right-hand ski, the inner ski 2, this exaggeration in the drawing also being a consequence of the fact that the radii of curvature R, r have been drawn short in relationship to the ski length.

Figure 2:
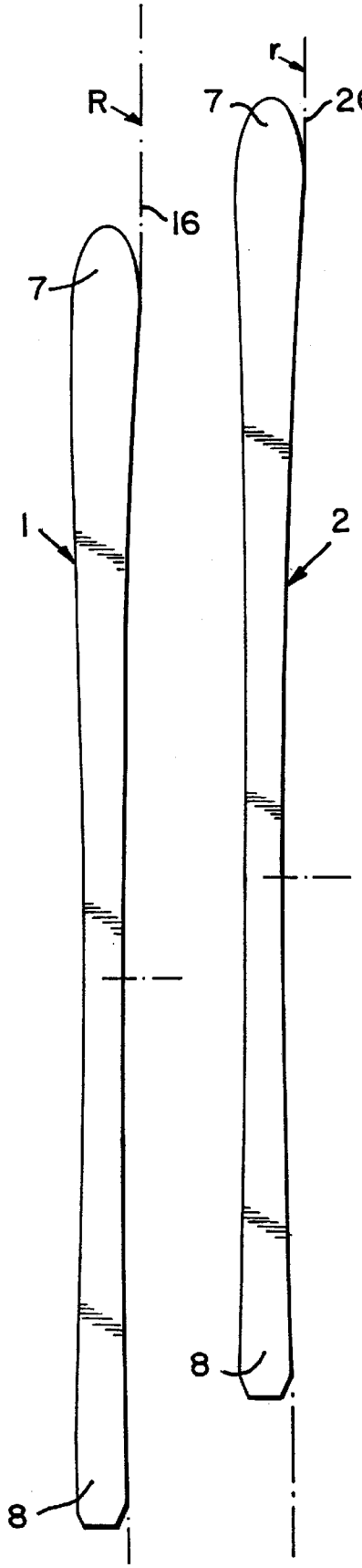

In FIG. 2, the two skis 1, 2 are drawn approximately true to scale during a comparable travel through curves (cf. the arcs 16 and 26, respectively) , the longitudinal offset of the respective outside waisting of the skis 1, 2 being well recognizable as compared to the inside waisting in the region neighbouring the respective ski shovel 7, primarily in the region of the ski ends 8. However, these geometric ratios can be seen more clearly in the top view according to FIG. 3 which is drawn on a larger scale. In the ski illustrated there, e.g. the ski 2, the concavely curved sidecut 25 starts at the inside of the ski 2 at a site 9 located more forwardly, viewed in the longitudinal direction of the ski, than the site 10 of the beginning of the concavely curved sidecut 24 at the outside of the ski 2. This offset in the longitudinal direction of the ski is denoted by the distance X in FIG. 3. Furthermore, the outside waisting, i.e. the curve of the outside sidecut 24, as compared to a symmetrical design drawn in dashed lines, and thus as compared to a waisting which would correspond to that on the (left-hand) inside of the ski 2, is outwardly offset by a distance Y, at the forward ski section adjacent the ski shovel 7. This outward offset of the outside waisting decreases to zero towards the ski end, yet at the ski end 8, a longitudinal offset of the outside waisting (outside sidecut 24) towards the rear by a distance x as compared to the waisting at the inside of the ski 2, is recognizable. In this case, the distance x preferably is smaller than the distance X, as can be recognized from the illustration in FIG. 3. Besides, it is also possible for the waisting (sidecut 24) at the outside of each ski 1, 2 to reach as far as to the outermost ski end.

Between the transverse lines extending through sites 9 and 10, respectively, following upon the concavely curved sidecut 24 (or 14 in the instance of ski 1, respectively), at the outside of ski 2 a straight section 11 is provided, which preferably extends parallel to the longitudinal axis of ski 2, optionally also forwardly diverging relative to the longitudinal axis of the ski 2, so as to avoid a rearwardly widening, plow-type geometry with its corresponding braking effect in this region.

In the region of the transitions from and to this straight section 11 at the respective outside of the ski as well as in the region of the concave-convex-transitions close to the respective ski shovel 7 or the respective ski end 8, respectively, the delimiting curves are formed by individual, smothly merging curve portions, socalled splines.

Tests have shown that in skis, as illustrated and having conventional ski lengths, e.g. 170 cm to 205 cm, the longitudinal offset of the waistings towards the front (distance X) and towards the rear (distance x), respectively, may in any event be equal and amount to e.g. 4 cm or 3 cm, respectively, the outward offset of the outside waisting in the forward ski region (distance Y) changing with the ski length; with ski lengths in the range of 200 cm, the distance Y is approximately 2.5 mm, possibly 2.2 mm to 2.3 mm (2.5 mm is considered the preferred maximum, even though offsets of up to 4 mm are also possible); with shorter ski lengths, e.g. 170 cm, the distance Y preferably is approximately 1.5 mm, under certain circunstances even merely approximately 1 mm. Without this outward offset Y, the longitudinal offset X would have to be dimensioned accordingly larger (e.g. twice or 3 times as large). The radii of curvature R and r, respectively, will be different depending on the ski lengths, and for ski lengths of approximately 200/205 cm, they will amount e.g. to 28 m or 26 m, respectively, for ski lengths of 170 cm, e.g., they will be 26 m/24 m.

As tests have shown, with the ski geometry described, the largest ski width in the region of the shovel 7 may be approximately 10 cm, that is with a ski length of approximately 200 cm, whereas the largest width at the ski end 8 will be approximately 8 cm at this ski length. At a ski length of 200 cm, the width of the narrowest, approximately central location of the ski will be approximately 6 cm. With ski lengths of 170 cm, the respective dimensions may be as follows: largest width at ski shovel 7: 8.8 cm; largest width at ski end: 7.6 cm; smallest width (ski center): 6 cm.

The skis 1, 2 may be produced according to conventional modes of construction, e.g. in sandwich construction or in monocoque construction.

What is claimed is:

1. A pair of skis for alpine skiing, where the skis each have an asymmetrical waisting, each ski at its outside comprising a sidecut of heavier curvature than at its inside, wherein the waisting at the outside of each ski is rearwardly offset relative to the waisting at the inside of that ski, so that when going through curves, when the two skis are guided at a distance from each other, with the outer ski rearwardly offset in travel direction relative to the inner ski, the waistings of the outside of the inner ski and of the inside of the outer ski describe at least approximately concentric curves.

2. A pair of skis according to claim 1 wherein the centers of curvature of the waistings at the inside of the outer ski and of the outside of the inner ski substantially coincide at a center-to-center distance of approximately 30 cm to 50 cm and at a rearward offset of the outer ski relative to the inner ski of approximately 10 cm to 25 cm.

3. A pair of skis in accordance with claim 2, where the centers of curvature coincide at a rearward offset of the outer ski to the inner ski of approximately 15 cm to 25 cm.

4. A pair of skis according to claim 1 wherein the distance of the rearward offset of the beginning of the outside waisting of each ski in the region adjacent the ski shovel is approximately 4 cm.

5. A pair of skis according to claim 1 wherein the beginning of the waisting at the outside of each ski, following upon the shovel region, is outwardly offset as compared to the waisting at the inside, the offset of the waisting at the ski outside diminishing rearwardly.

6. A pair of skis according to claim 5, wherein the amount of the outward offset of the outside waisting of each ski is in the range of from 1 mm to 4 mm.

7. A pair of skis according to claim 6, wherein the amount of the outward offset of the outside waisting of each ski is in the range of from 1.5 mm to 2.5 mm.

8. A pair of skis according to claim 1, wherein the waisting at the outside of each ski, in the region of the ski end, ends further rearwardly than the waisting at the inside of the ski.

9. A pair of skis according to claim 8, wherein the distance by which the waisting at the outside ends further rearwardly as compared to that on the inside is smaller than the distance of the rearward offset of the beginning of the outer waisting in the region adjacent the ski shovel.

10. A pair of skis according to claim 9, wherein the distance of the rearward offset of the outside waisting in the region of the ski end is approximately 3 cm.

11. A pair of skis according to claim 1, characterized in that the outside edge of each ski forward of the beginning of the outside waisting towards the shovel section is parallel to the longitudinal axis of the ski.

12. A pair of skis according to claim 1, characterized in that the outside edge of each ski forward of the beginning of the outside waisting towards the shovel section diverges outwardly from the longitudinal axis of the ski.

13. A pair of skis in accordance with claim 10 where the centers of curvature coincide at a rearward offset of the outer ski to the inner ski of approximately 15 cm to 25 cm.

* * * * *